US009341423B2

(12) United States Patent
McGinty

(10) Patent No.: US 9,341,423 B2
(45) Date of Patent: May 17, 2016

(54) DUAL EJECTION PORT FIREARM

(71) Applicant: S. I. DEFENSE, INC., Kalispell, MT (US)

(72) Inventor: Aaron A. McGinty, Kalispell, MT (US)

(73) Assignee: S. I. DEFENSE, INC., Kalispell, MT (US)

( * ) Notice: Subject to any disclaimer, the term of this patent is extended or adjusted under 35 U.S.C. 154(b) by 0 days.

(21) Appl. No.: 14/581,755

(22) Filed: Dec. 23, 2014

(65) Prior Publication Data

US 2015/0323273 A1 Nov. 12, 2015

Related U.S. Application Data

(60) Provisional application No. 61/920,213, filed on Dec. 23, 2013, provisional application No. 61/920,234, filed on Dec. 23, 2013.

(51) Int. Cl.
*F41A 15/14* (2006.01)
*F41A 3/12* (2006.01)
*F41A 3/26* (2006.01)

(52) U.S. Cl.
CPC . *F41A 15/14* (2013.01); *F41A 3/12* (2013.01); *F41A 3/26* (2013.01)

(58) Field of Classification Search
CPC ..... F41A 15/12; F41A 15/14; F41A 3/26; F41A 3/28; F41A 3/12
USPC ..... 42/25, 96
See application file for complete search history.

(56) References Cited

U.S. PATENT DOCUMENTS

| | | | | |
|---|---|---|---|---|
| 8,307,750 | B2 | 11/2012 | Vuksanovich et al. | |
| 8,893,608 | B2 | 11/2014 | Kramer | |
| 8,899,138 | B2 | 12/2014 | Brown | |
| 8,910,406 | B1 | 12/2014 | Huang et al. | |
| 2002/0026739 | A1 * | 3/2002 | Murello | F41A 3/26 42/46 |
| 2002/0073592 | A1 * | 6/2002 | Murello | F41A 3/26 42/25 |
| 2011/0232149 | A1 * | 9/2011 | Fargnoli | F41A 3/54 42/16 |

OTHER PUBLICATIONS

U.S. Appl. No. 61/920,008, filed Dec. 23, 2013, titled "Quick-Release Barrel Firearm", Inventor: Aaron A. McGinty.
U.S. Appl. No. 14/579,797, filed Dec. 22, 2014, titled "Quick-ReleaseFirearm", Inventor: Aaron A. McGinty.
(Continued)

*Primary Examiner* — Stephen M Johnson
(74) *Attorney, Agent, or Firm* — Bennett K. Langlotz; Langlotz Patent & Trademark Works, Inc.

(57) ABSTRACT

Firearms with improved systems and methods of controlling which side of the firearm shell casings are ejected from, with ejection port covers on both sides of the firearm that open to provide cross ventilation, or both. In some embodiments, the bolt can be installed in one of two different orientations to select whether shell casings are ejected from the left or the right ejection port without a need to replace any parts. In a number of embodiments, spring loaded ejection port covers on both sides open when the firearm is fired or when the bolt or carrier of the firearm moves to provide cross ventilation through a passageway through the firearm to cool the firearm. The covers can be manually closed by the operator when the weapon is not being fired to keep dirt and debris out of the firearm.

21 Claims, 4 Drawing Sheets

(56) References Cited

OTHER PUBLICATIONS

U.S. Appl. No. 61/920,026, filed Dec. 23, 2013, titled "Internal Latch in Charging Handle of Firearm", Inventor: Aaron A. McGinty.
U.S. Appl. No. 14/579,893, filed Dec. 22, 2014, titled "Internal Latch in Charging Handle of Firearm", Inventor: Aaron A. McGinty.
U.S. Appl. No. 61/920,164, filed Dec. 23, 2013, titled "Intermediate Charging Handle Engagement With Carrier of Firearm", Inventor: Aaron A. McGinty.
U.S. Appl. No. 14/581,694, filed Dec. 23, 2014, titled "Intermediate Charging Handle Engagement With Carrier of Firearm", Inventor: Aaron A. McGinty.
U.S. Appl. No. 61/920,234, filed Dec. 23, 2013, titled "Cross Ventilation Through Ejection Ports of Firearm", Inventor: Aaron A. McGinty.
U.S. Appl. No. 61/925,768, filed Jan. 10, 2014, titled "Ambidextrous Bolt Catch of Firearm", Inventor: Aaron A. McGinty.
U.S. Appl. No. 14/594,924, filed Jan. 12, 2015, titled "Ambidextrous Bolt Catch and Magazine Release and Firearm", Inventor: Aaron A. McGinty.
U.S. Appl. No. 61/932,874, filed Jan. 29, 2014, titled "Bolt Buffer and Firearm", Inventor: Aaron A. McGinty.
U.S. Appl. No. 14/608,894, filed Feb. 10, 2015, titled "Bolt Buffer and Firearm", Inventor: Aaron A. McGinty.
U.S. Appl. No. 61/936,022, filed Feb. 5, 2014, titled "Carrier Guide and Firearm", Inventor: Aaron A. McGinty.
U.S. Appl. No. 14/593,116, filed Jan. 9, 2015, titled "Carrier Guide and Firearm", Inventor: Aaron A. McGinty.
U.S. Appl. No. 61/943,860, filed Feb. 24, 2014, titled "Handguard With Integrated POD and Firearm", Inventor: Aaron A. McGinty.
U.S. Appl. No. 14/625,183, filed Feb. 18, 2015, titled "Handguard With Integrated POD and Firearm", Inventor: Aaron A. McGinty.
U.S. Appl. No. 61/949,907, filed Mar. 7, 2014, titled "Charging Handle Engagement With Carrier Key of Firearm", Inventor: Aaron A. McGinty.
U.S. Appl. No. 14/632,706, filed Feb. 26, 2015, titled "Charging Handle Engagement With Carrier Key of Firearm", Inventor: Aaron A. McGinty.
U.S. Appl. No. 61/974,322, filed Apr. 2, 2014, titled "Ambidextrous Magazine Release and Firearm", Inventor: Aaron A. McGinty.
"Faxon Firearms Brings the ARAK Platform into the .30 Cal World", Edward Osborne, Jan. 26, 2015, Shooting Sports News; http://www.outdoorhub.com/news/2015/01/26/faxon-firearms-brings-arak-platform-30-cal-world/.

* cited by examiner

SECTION A-A

DETAIL B
BOLT ROTATED 180°

DETAIL B
BOLT ROTATED 0°

DETAIL C

BOLT HEAD ROTATED 0°
SHELL EJECTION ON RIGHT SIDE

BOLT HEAD ROTATED 180°
SHELL EJECTION ON LEFT SIDE

DUAL EJECTION PORT FIREARM

RELATED PATENT APPLICATIONS

This patent application claims priority to U.S. Provisional Patent Application No. 61/920,213, filed on Dec. 23, 2013, titled FIREARM CAPABLE OF EJECTING SHELL CASINGS ON EITHER SIDE, and to U.S. Provisional Patent Application No. 61/920,234, also filed on Dec. 23, 2013, titled, CROSS VENTILATION THROUGH EJECTION PORTS OF FIREARM which each have at least one inventor in common with the current patent application and the same assignee. The contents of these priority provisional patent applications are incorporated herein by reference.

FIELD OF THE INVENTION

Various embodiments of this invention relate to firearms. Particular embodiments relate to firearms having bilateral ejection ports or that are capable of selectively ejecting shell casings on either side of the firearm. Certain embodiments relate to firearms having active cooling systems.

BACKGROUND OF THE INVENTION

Firearms have been used for several centuries for various purposes including as weapons for warfare, law enforcement, self defense, hunting, and target practice. Although many new weapons and weapon systems have been developed, firearms are still widely used and soldiers are trained in firearm use and carry firearms in essentially all armies throughout the world. Over time, firearms have been improved in many ways, but opportunities for improvement still exist in particular areas and for particular aspects of these devices.

Firearms have been constructed with an ejection port where spent shell casings exit the weapon. Firearms have been manufactured with ejection ports on either side of the weapon and different users prefer right side or left side ejection ports, depending, for example, on whether the user is right handed or left handed or plans to shoot from a right handed stance or a left handed stance. Firearms have been sold that can be converted from a right side ejection port to a left side ejection port, or vice versa, but such firearms typically required additional parts to make the conversion. These additional parts either were not sold with the firearm or added cost to the weapon. A need or potential for benefit or improvement exists for firearms that can be converted from a right side ejection port to a left side ejection port, or vice versa, without additional parts, more easily, more quickly, without adding complexity to the weapon, or a combination thereof, as examples.

In addition, firearms have been equipped with a dust cover over the ejection port to keep dirt and debris from entering the ejection port. Moreover, firearms have been manufactured where the dust cover opens automatically, for example, when the weapon is fired or when the bolt or carrier is moved (e.g., in either direction). But such firearms have typically opened the dust cover for only one ejection port at a time. Furthermore, it has long been recognized that firearms can overheat in a battlefield situation where the firearm is fired a large number of times in a relatively short period of time. Firearms have been designed with various characteristics that promote cooling, including promoting ventilation of the barrel. Needs or potential for benefit or improvement exist, however, for firearms that dissipate heat better, more easily, more quickly, from other parts of the firearm, without adding excessive complexity to the weapon, or a combination thereof, as examples.

Room for improvement exists over the prior art in these and other areas that may be apparent to a person of skill in the art having studied this document.

SUMMARY OF PARTICULAR EMBODIMENTS OF THE INVENTION

This invention provides, among other things, firearms with improved systems and methods of providing for ejection of shell casings from either side of the weapon. Various embodiments provide firearms with an ejection port on each side of the weapon and different users can configure the weapon to use the right side or left side ejection port, depending, for example, on whether the user is right handed or left handed or plans to shoot from a right handed stance or a left handed stance. Particular embodiments do not require additional, parts to make the conversion (e.g., parts that either are not sold with the firearm or add cost to the weapon). Certain embodiments provide firearms that can be converted from a right side ejection port to a left side ejection port, or vice versa, without additional parts, more easily, more quickly, without adding complexity to the weapon, or a combination thereof, as examples.

This invention also provides firearms with improved systems and methods of cooling of the weapon. Certain embodiments provide for both ejection of shell casings and cooling of the weapon. Various embodiments provide firearms with an ejection port on each side of the weapon and different embodiments provide enhanced cooling the weapon by opening both the right side and left side dust covers over the ejection ports, thereby providing cross ventilation of the bolt and rear of the chamber. Further, various embodiments provide for covering of the cooling system of a firearm, when not needed, to avoid the admission of dirt or debris.

Other embodiments, besides firearms, include bolts for firearms and methods of configuring or obtaining or providing a firearm or bolt for a firearm, for example, to selectably eject shell casings through either side of the firearm, for instance, with features described herein. Further embodiments include bolts for firearms, carriers for firearms, and methods of configuring, obtaining, or providing a firearm that provide cross ventilation through the firearm, for instance, through bilateral ejection ports.

Various embodiments provide, for example, as an object or benefit, that they partially or fully address or satisfy one or more of the needs, potential areas for benefit, or opportunities for improvement described herein, or known in the art, as examples. In a number of embodiments, improvements to firearms herein provide for firearms that are more reliable, that last longer, that are more adaptable, that can be used in conditions that are more extreme, that handle abuse well, that work better, that are easier to use, that are easier to maintain, that are less expensive to manufacture, that have a lower lifecycle cost, that offer more options for use, that can be fired at a high firing rate for a longer period of time, or a combination thereof. In addition, various other embodiments of the invention are also described herein, and other benefits of certain embodiments may be apparent to a person of skill in this area of technology.

Specific embodiments include various firearms that include, for instance, a left ejection port, a right ejection port, a bolt having a first side and a second side, or a combination thereof. In various embodiments, for example, the bolt can be installed in the firearm with the first side up, the bolt can be installed in the firearm with the second side up, when the bolt is installed in the firearm with the first side up, shell casings are ejected though the right ejection port, and when the bolt is installed in the firearm with the second side up, shell casings are ejected though the left ejection port. In some embodiments, for example, the firearm includes a left side and a right side, the left ejection port is on the left side of the firearm, and the right ejection port is on the right side of the firearm. Further, in a number of embodiments, the bolt has a central axis, and when the bolt is installed in the firearm with the second side up, the bolt is rotated 180 degrees around the central axis from when the bolt is installed in the firearm with the first side up.

Further, in some embodiments, for example, the bolt includes an ejection pin, and when the bolt is installed in the firearm with the first side up so that shell casings are ejected though the right ejection port, the ejection pin is left of the central axis of the bolt, between the central axis and the left side of the firearm. Further still, in a number of embodiments, when the bolt is installed in the firearm with the second side up so that shell casings are ejected though the left ejection port, the ejection pin is right of the central axis of the bolt, between the central axis and the right side of the firearm.

Even further, in some embodiments, for example, the bolt includes an extractor claw, and when the bolt is installed in the firearm with the first side up so that shell casings are ejected though the right ejection port, the extractor claw is right of the central axis of the bolt, between the central axis and the right side of the firearm. Even further still, in a number of embodiments, when the bolt is installed in the firearm with the second side up so that shell casings are ejected though the left ejection port, the extractor claw is left of the central axis of the bolt, between the central axis and the left side of the firearm.

Moreover, in some embodiments, for example, the bolt includes a first set of ejection features on the first side of the bolt and a second set of ejection features on the second side of the bolt, and the second set of ejection features is a mirror opposite of the first set of ejection features. Further, in some embodiments, for example, the firearm includes a receiver that includes the left ejection port and the right ejection port, the bolt is contained within the receiver, and the bolt and the receiver are configured so that the bolt can be installed in the receiver with the first side up and the bolt can be installed in the receiver with the second side up. Further still, in some embodiments, for example, the firearm includes a carrier that includes a forward end, the bolt engages the carrier at the forward end of the carrier, and the bolt and the forward end of the carrier are configured so that the bolt can operationally engage the forward end of the carrier with the first side up and the bolt can operationally engage the forward end of the carrier with the second side up.

Other specific embodiments include various firearms that include a left side, a right side, a left port at the left side, a right port at the right side, a left cover at the left port, a right cover at the right port, and a passageway extending from the left port to the right port. Further a number of embodiments include an opening mechanism that automatically opens both the left cover and the right cover when the firearm is discharged. In various embodiments, for example, when the left cover is closed, the left cover covers the left port covering the passageway at the left side, and when the right cover is closed, the right cover covers the right port covering the passageway at the right side. Still further, in a number of such embodiments, when the left cover opens, the left cover uncovers the left port opening the passageway at the left side, and when the right cover is opened, the right cover uncovers the right port opening the passageway at the right side.

In some embodiments, for example, the opening mechanism automatically opens both the left cover and the right cover when the firearm is discharged. Further, in some embodiments, for instance, the opening mechanism automatically opens both the left cover and the right cover when a round is chambered within the firearm. Still further, in some embodiments, for example, the left cover is a left ejection port, the right cover is a right ejection port, the left cover is a left dust cover at the left ejection port, and the right cover is a right dust cover at the right ejection port. Even further, in some embodiments, for example, the firearm includes a receiver, a left hinge, a right hinge, a left spring, a right spring, a left latch, and a right latch. In a number of embodiments, for instance, the left dust cover is attached to the receiver with the left hinge, the right dust cover is attached to the receiver with the right hinge, the left dust cover is biased open with the left spring, the right dust cover is biased open with the right spring, the left dust cover is held closed with the left latch, and the right dust cover is held closed with the right latch.

Moreover, in some embodiments, for example, the left dust cover is held closed with the left latch when the left dust cover is manually pushed closed, the right dust cover is held closed with the right latch when the right dust cover is manually pushed closed, and the opening mechanism opens the left dust cover and the right dust cover by releasing the left latch and the right latch. Further still, in some embodiments, for example, the firearm includes a bolt, the opening mechanism includes a left bolt feature and a right bolt feature, the opening mechanism includes a left cover feature and a right cover feature, or both. Even further still, in a number of embodiments, the left cover feature is part of the left dust cover, the right cover feature is part of the right dust cover, the left dust cover opens when the left bolt feature contacts the left cover feature, and the right dust cover opens when the right bolt feature contacts the right cover feature, or a combination thereof, as examples.

Still other specific embodiments include various firearms that include a left ejection port, a right ejection port, a left dust cover at the left ejection port, a right dust cover at the right ejection port, a passageway extending from the left ejection port to the right ejection port, and a bolt carrier group having a first feature and a second feature. In various embodiments, for example, the first feature automatically opens the left dust cover when the bolt carrier group moves and the second feature automatically opens the right dust cover when the bolt carrier group moves, for instance, to provide cross ventilation through the passageway to the bolt carrier group when the left dust cover and the right dust cover are open. Further, in certain embodiments, for example, the bolt carrier group includes a carrier and a bolt having a first side and a second side, the bolt can be installed in the carrier with the first side up, and the bolt can be installed in the carrier with the second side up. Moreover, in a number of embodiments, when the bolt is installed in the carrier with the first side up, shell casings are ejected though the right ejection port, and when the bolt is installed in the carrier with the second side up, shell casings are ejected though the left ejection port.

BRIEF DESCRIPTION OF THE DRAWINGS

The drawings provided herewith illustrate, among other things, examples of certain aspects of particular embodiments. Other embodiments may differ. Various embodiments may include aspects shown in the drawings, described in the specification (including the claims), known in the art, or a combination thereof, as examples. Other embodiments, however, may differ.

DETAILED DESCRIPTION OF EXAMPLES OF EMBODIMENTS

This patent application describes, among other things, examples of certain embodiments, and certain aspects thereof. Other embodiments may differ from the particular examples described in detail herein. Various embodiments are or concern firearms, for example, having improvements over the prior art. Different embodiments include firearms, mechanisms for firearms, bolts for firearms, methods concerning ejection of shell casings from firearms, and methods concerning cooling of and/or ejection of shell casings from firearms, as examples.

Certain embodiments include firearms with improved systems and methods of controlling which side of the firearm shell casings are ejected from, firearms with ejection port covers on both sides of the firearm that open to provide cross ventilation, and firearms with both such features. In some embodiments, the bolt can be installed in one of two different orientations to select whether shell casings are ejected from the left or the right ejection port, for example, in a number of embodiments, without a need to replace any parts. In various embodiments, spring loaded ejection port covers on both sides open when the firearm is fired or when the bolt or carrier of the firearm moves, as examples, to provide cross ventilation through a passageway through the firearm, for instance, to cool the firearm. The covers can be manually closed by the operator, in a number of embodiments, when the weapon is not being fired, to keep dirt and debris out of the firearm.

In a number of embodiments, for example, a firearm (e.g., 10 shown in FIGS. 1-3) includes, among other things, a left ejection port (e.g., 41 shown in FIGS. 4 and 5), a right ejection port (e.g., 42 shown in FIGS. 1 and 4-6); and a bolt (e.g., 70 shown in FIGS. 3-5 and 7-11). In various embodiments, the bolt (e.g., 70) has a first side (e.g., 71 shown in FIGS. 7 and 9-11) and a second side (e.g., 82 shown in FIGS. 8, 10, and 11). In various embodiments, as used herein, a "bolt" is a bolt assembly. In some embodiments, the firearm (e.g., 10) is configured to selectably eject shell casings through either side of the firearm. Further, in a number of embodiments, for instance, the firearm is configured so that a bolt (e.g., 70) of the firearm can be installed in the firearm in either of two different orientations (e.g., shown in FIGS. 7 and 8).

Figure 7:
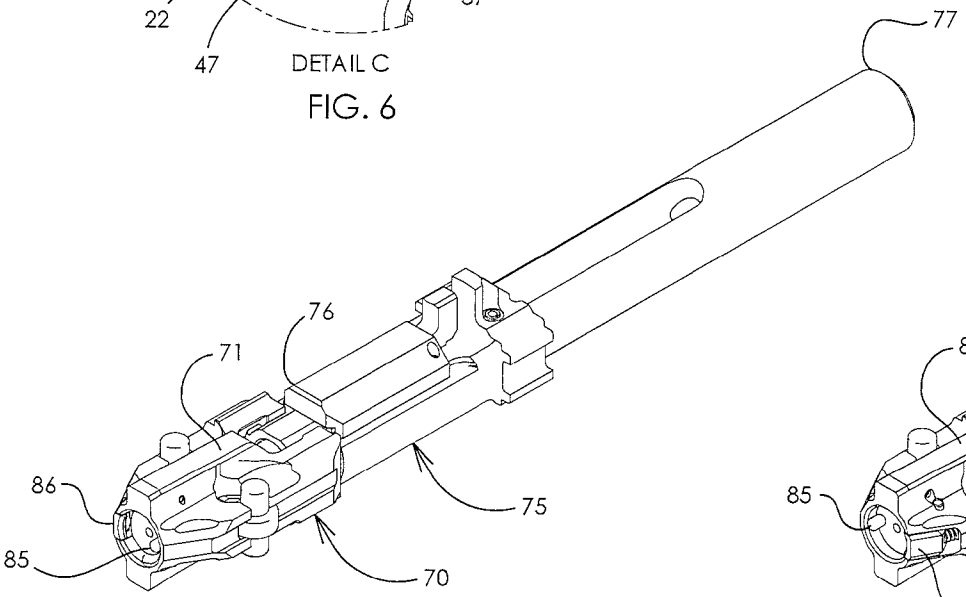
FIG. 7 is an isometric view of the bolt carrier group of the firearm of FIGS. 1-6 illustrated in the first orientation of FIG. 4.
Figure 8:
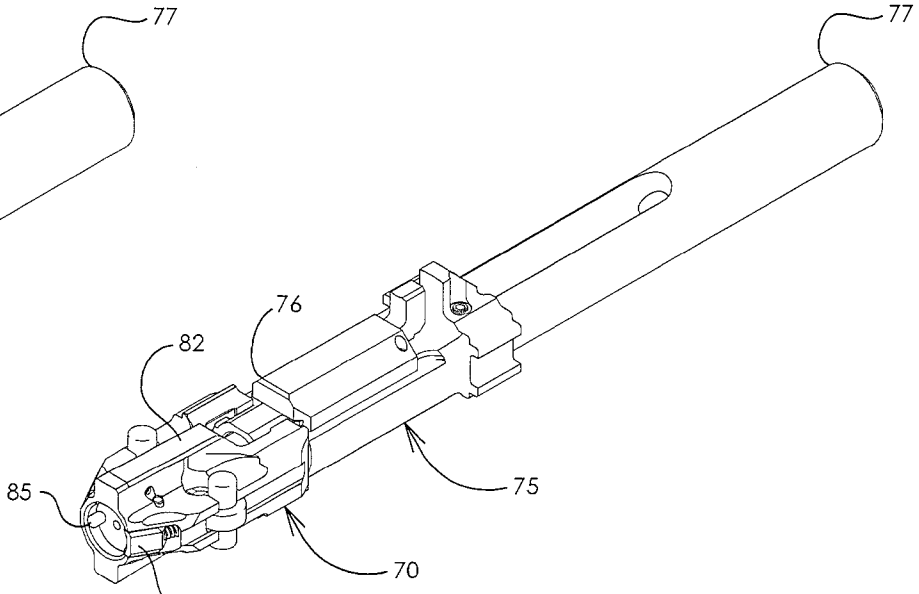
FIG. 8 is an isometric view of the bolt carrier group of the firearm of FIGS. 1-6 illustrated in the second orientation of FIG. 5.

In certain embodiments, when the bolt (e.g., 70) is installed, for example, in a first orientation (e.g., as shown in FIG. 7), shell casings are ejected (i.e., when the firearm is fired or discharged) though a right ejection port (e.g., 42), and when the bolt is installed in a second orientation (e.g., as shown in FIG. 8), shell casings are ejected (i.e., when the firearm is fired or discharged) though a left ejection port (e.g., 41). For example, in various embodiments, the bolt (e.g., 70) can be installed in the firearm with the first side (e.g., 71) up and the bolt can also (i.e., alternatively, at the option of the operator or other person who assembles or maintains the firearm) be installed in the firearm with the second side (e.g., 82) up. As used herein, where a bolt "can be installed" in a firearm "with the first side up" and "with the second side up" the bolt can be removed and reinstalled by an operator of the firearm, in either orientation (i.e., ether first side or second side up) without destruction or replacement of any parts of the firearm and in the course of ordinary maintenance of the firearm that would typically be performed by the owner or operator of the weapon, for instance, for cleaning and/or lubrication of the weapon.

Figure 1:
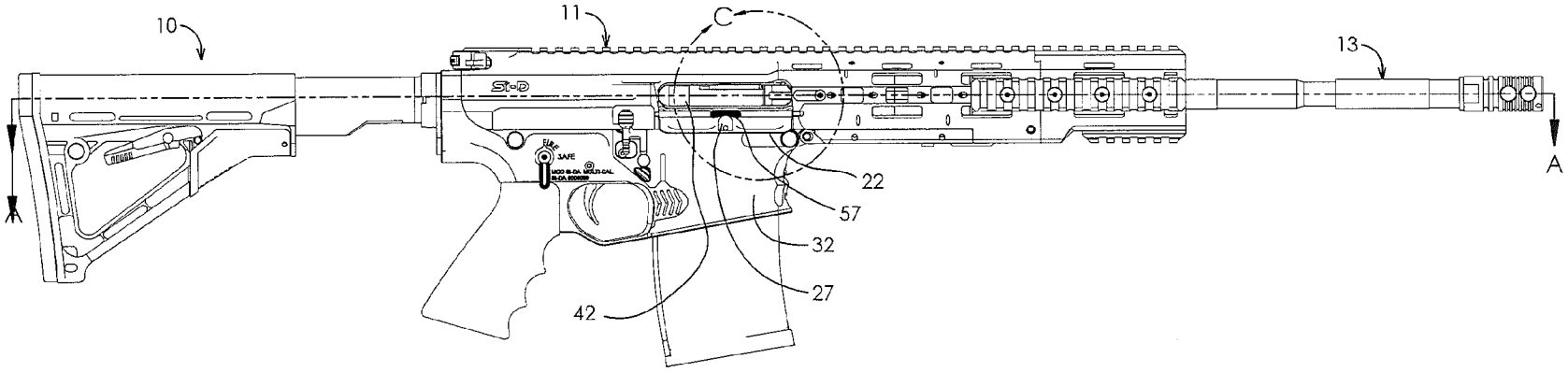
FIG. 1 is a right side view of an embodiment of a firearm that includes a dust cover on the right side that is open.
Figure 2:
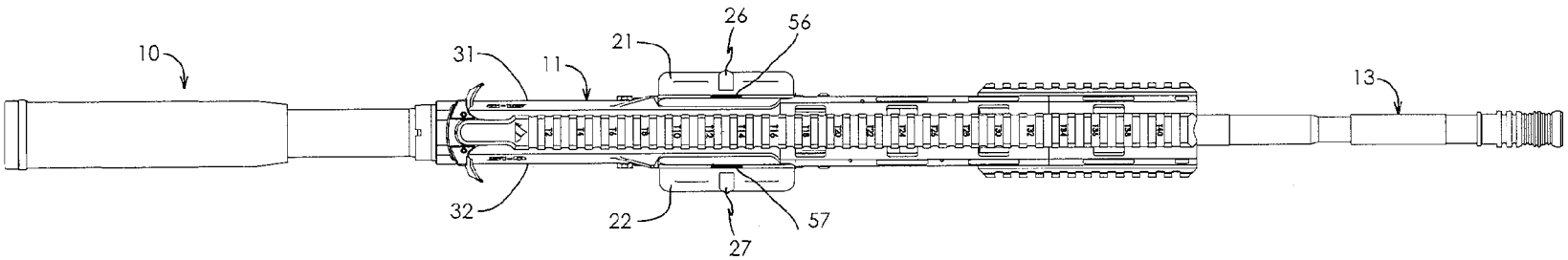
FIG. 2 is a top view of the firearm of FIG. 1 showing dust covers open on both sides of the firearm.
Figure 3:
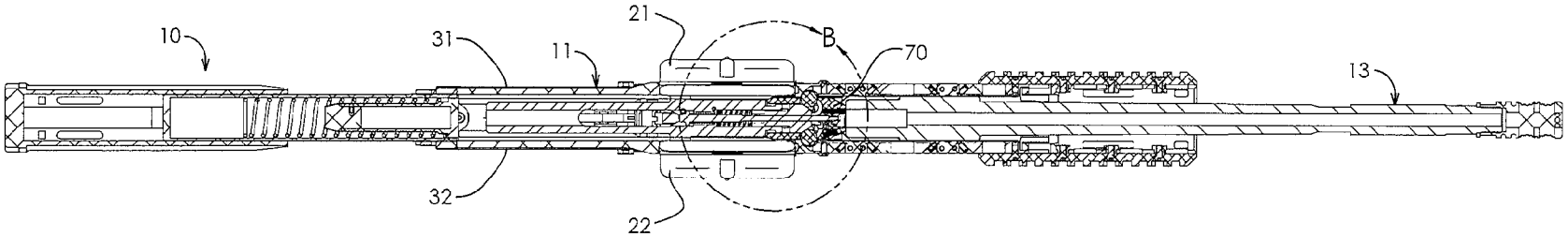
FIG. 3 is a top cross-sectional view of the firearm of FIGS. 1 and 2, taken along section A-A in FIG. 1, illustrating, among other things, the bolt of the firearm.
Figure 5:
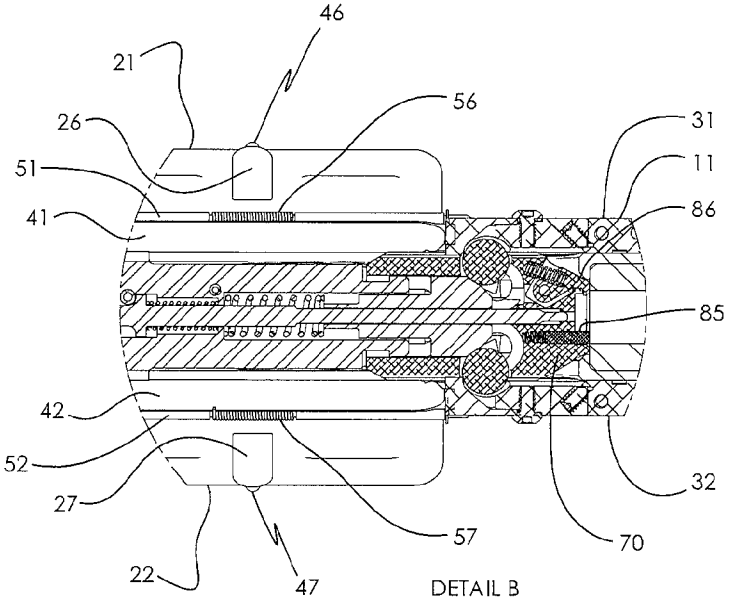
FIG. 5 is the same top detail view of FIG. 4 of the part of the firearm of FIG. 3 except illustrating the ejection pin and extractor claw of the bolt in a second orientation with the bolt rotated 180 degrees from the first orientation.
Figure 4:
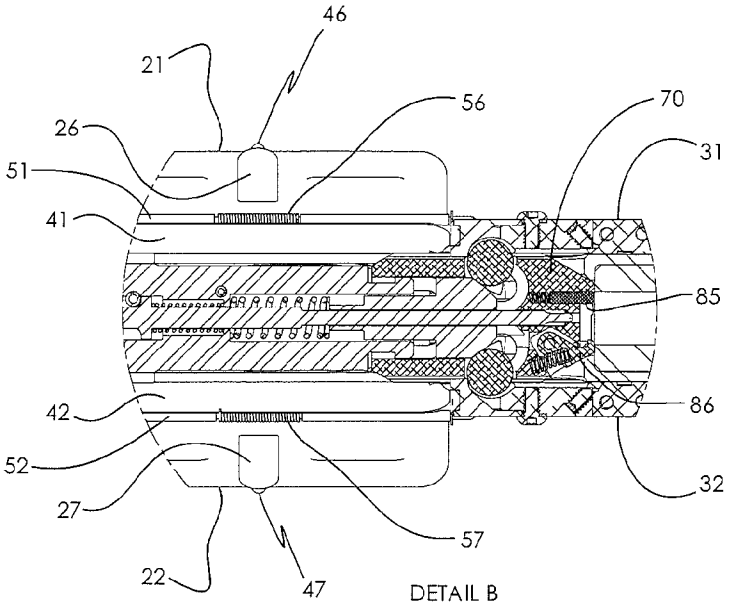
FIG. 4 is a top detail view of part of the firearm of FIG. 3 illustrating the ejection pin and extractor claw of the bolt in a first orientation.
Figure 6:
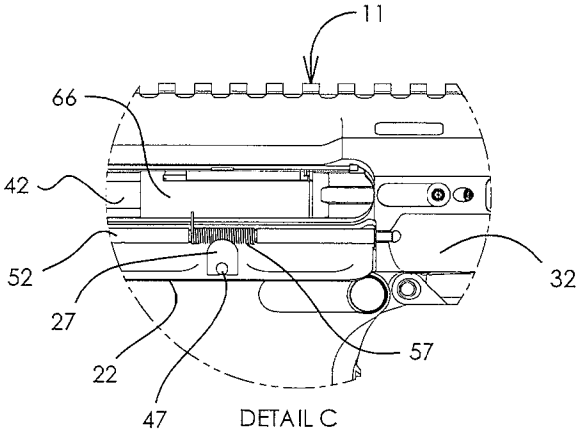
FIG. 6 is a right side detail view of part of the firearm of FIG. 1 illustrating, among other things, the right ejection port and dust cover.

In this context, "up", as well as "left" and "right" are relative to the orientation of the firearm (i.e., when the firearm is in its normal orientation when being used with the barrel (e.g., 13) horizontal as shown in FIG. 1). In this context "can be installed" means without changing out or modifying any parts of the firearm and in a manner that renders the firearm operational for use firing multiple rounds. Further in certain embodiments, when the bolt (e.g., 70) is installed in the firearm with the first side (e.g., 71) up, shell casings are ejected though the right ejection port (e.g., 42), and when the bolt is installed in the firearm with the second side (e.g., 82) up, shell casings are ejected though the left ejection port (e.g., 41). In this context, the shell casings are ejected through the appropriate ejection port when the firearm is discharged.

In a number of embodiments, each ejection port (e.g., 41 and 42) has a dust cover (e.g., 21 and 22 shown in FIGS. 1-6), for example, that can be closed by the operator but that opens automatically, for example, when the bolt moves (e.g., in a number of embodiments, in either direction). In this context, as used herein, "can be closed by the operator" means that a typical person who fires the firearm can physically close the cover with the operator's fingers without any tools or other materials and without significant harm or discomfort to the operator so that the cover stays closed, for example, until the bolt is moved. In some embodiments, the dust cover for the ejection port that is not being used for the ejection of shell casings remains closed regardless of the movement of the bolt. In other embodiments, however, the dust cover for the ejection port that is not being used for the ejection of shell also opens when the bolt moves, for example, to provide cross ventilation for cooling of the weapon, for instance, in the event a large number of shots are fired in a relatively short period of time.

In various embodiments, the bolt (e.g., 70) includes an ejection pin (e.g., 85 shown in FIGS. 4, 5, 7 and 8), the bolt includes a extractor claw (e.g., 86 shown in FIGS. 4, 5, 7 and 8), or both. In different embodiments, the extractor claw (e.g., 86) or extraction claw grabs the casing and the ejection pin (e.g., 85) pushes the casing toward the direction of the extractor claw. Further, in a number of embodiments, the firearm includes a left side (e.g., 31 shown in FIGS. 2-5) and a right side (e.g., 32 shown in FIGS. 1-6), the left ejection port (e.g., 41) is on the left side of the firearm, the right ejection port (e.g., 42) is on the right side of the firearm (e.g., 10), and the bolt (e.g., 70) has a central axis (e.g., 99 shown in FIGS. 9-11). The central axis (e.g., 99) can be parallel to or concentric with the barrel (e.g., 13, for instance, the bore of the barrel) of the firearm (e.g., 10), in some embodiments, for example. Even further, in some embodiments, when the bolt (e.g., 70) is installed in the firearm (e.g., 10) with the second side (e.g., 82) up, the bolt is rotated 180 degrees (e.g., relative to the remainder of the firearm or the receiver, for instance) around the central axis (e.g., 99) from (i.e., in comparison to) when the bolt (e.g., 70) is installed in the firearm with the first side (e.g., 71) up.

In a number of embodiments where the bolt (e.g., 70) includes an ejection pin (e.g., 85), when the bolt is installed in the firearm (e.g., 10) with the first side up (e.g., 71) so that shell casings are ejected though the right ejection port (e.g., 42), the ejection pin (e.g., 85) is left of the central axis (e.g., 99) of the bolt (e.g., 70), for instance, between the central axis and the left side (e.g., 31) of the firearm (e.g., 10). Further, in a number of embodiments, when the bolt (e.g., 70) is installed in the firearm (e.g., 10) with the second side (e.g., 82) up so that shell casings are ejected though the left ejection port (e.g., 41), the ejection pin (e.g., 85) is right of the central axis (e.g., 99) of the bolt (e.g., 70), for example, between the central axis (e.g., 99) and the right side (e.g., 32) of the firearm (e.g., 10).

In various embodiments, installing the bolt (e.g., 70) with the extractor claw (e.g., 86) on the left side (e.g., left of centerline 99) will eject the shells on the left side (e.g., 31) of the firearm (e.g., 10). Further, in a number of embodiments, installing the bolt (e.g., 70) with the ejection pin (e.g., 85) on the right side (e.g., right of centerline 99) will eject the shells on the left side (e.g., 31) of the firearm (e.g., 10). On the other hand, in a number of embodiments, installing the bolt (e.g., 70) with the extractor claw (e.g., 86) on the right side (e.g., right of centerline 99) will eject the shells on the right side (e.g., 32) of the firearm (e.g., 10). Further, in a number of embodiments, installing the bolt (e.g., 70) with the ejection pin (e.g., 85) on the left side (e.g., left of centerline 99) will eject the shells on the right side (e.g., 32) of the firearm (e.g., 10).

Further, in a number of embodiments where the bolt (e.g., 70) includes a extractor claw (e.g., 86), when the bolt is installed in the firearm (e.g., 10) with the first side (e.g., 71) up so that shell casings are ejected though the left ejection port (e.g., 41), the extractor claw (e.g., 86) is left of the central axis (e.g., 99) of the bolt (e.g., 70), between the central axis and the left side (e.g., 31) of the firearm (e.g., 10). Further, in a number of embodiments, when the bolt (e.g., 70) is installed in the firearm with the second side (e.g., 82) up so that shell casings are ejected though the right ejection port (e.g., 42), the extractor claw (e.g., 86) is right of the central axis (e.g., 99) of the bolt, between the central axis and the right side (e.g., 32) of the firearm.

In some embodiments, the bolt (e.g., 70) includes a first set of ejection features on the first side (e.g., 71) of the bolt and a second set of ejection features on the second side (e.g., 82) of the bolt, and the second set of ejection features is a mirror opposite (e.g., identical but opposite hand) of the first set of ejection features (i.e., within an appropriate tolerance). In a number of embodiments, these ejection features direct the shell casing to the appropriate ejection port (e.g., 41 or 42), for example, immediately after the firearm is discharged. In certain embodiments, the second set of ejection features is a mirror opposite of the first set of ejection features across a plane through the bolt (e.g., 70) that includes the central axis (e.g., 99) of the bolt, for example. Further, in some embodiments, the bolt can contain other features that are identical or mirror opposites on the first and second sides of the bolt, besides the ejection features, and in certain embodiments, the bolt can contain further features that are different on the first and second sides of the bolt.

Figure 10:
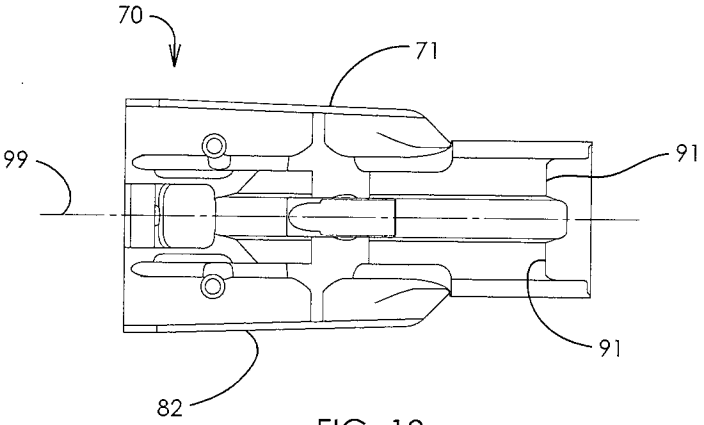
FIG. 10 is a right side view of the bolt of the firearm of FIGS. 1-6 illustrated in the first orientation of FIGS. 4 and 7.
Figure 11:
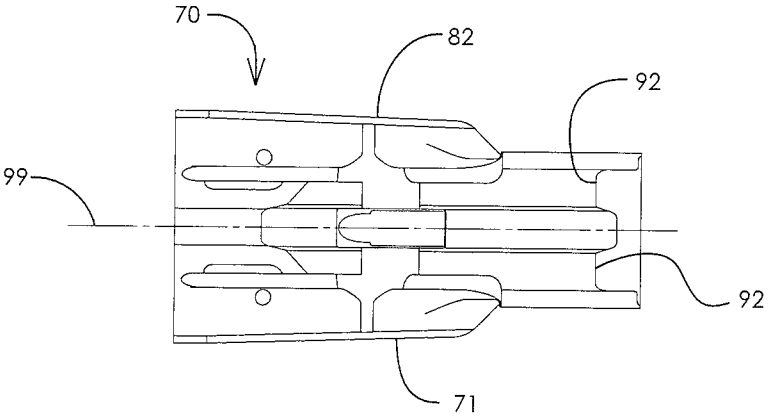
FIG. 11 is a left side view of the bolt of the firearm of FIGS. 1-6 illustrated in the second orientation of FIGS. 5 and 8.
Figure 9:
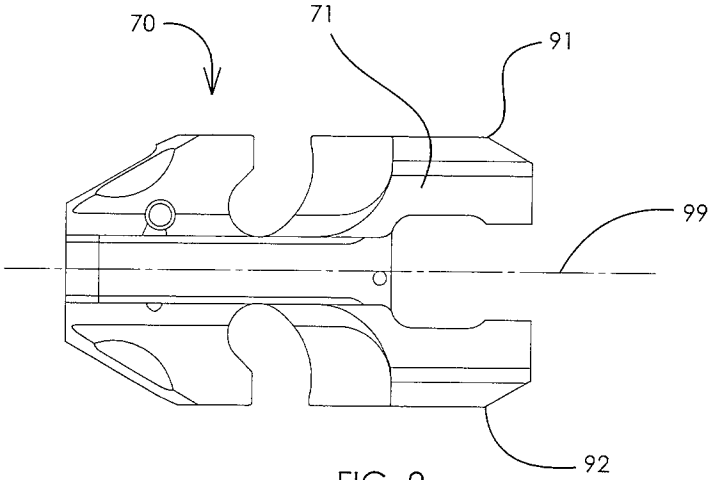
FIG. 9 is a top view of the bolt of the firearm of FIGS. 1-6 illustrated in the first orientation of FIGS. 4 and 7.

In the embodiment illustrated, FIG. 7 illustrates a first set of ejection features on first side 71 of the bolt and FIG. 8 illustrates a second set of ejection features on second side 82 of the bolt. In this embodiment, the first and second sets of ejection features include features that are mirror opposite (e.g., identical but opposite hand) in these two views. In addition, FIGS. 10 and 11 illustrate first side 71 and second side 82 from right side and left side views, depicting, among other things, the ejection features on first side 71 and second side 82, in the embodiment shown.

In a number of embodiments, the left ejection port (e.g., 41) and the right ejection port (e.g., 42) are in the receiver (e.g., 11) of the firearm (e.g., 10). In various embodiments, the bolt (e.g., 70) is contained within the receiver (e.g., 11) and the bolt and the receiver are configured so that the bolt can be installed in the receiver with the first side (e.g., 71) up and the bolt can be installed in the receiver with the second side (e.g., 82) up. As used herein, a first part or set of parts being "configured" for a first function requires that the first part or set of parts be specifically adapted to perform the first function. In other embodiments, however, the first part or set of parts can be capable of the first function, which does not require such a specific adaptation. For example, in other embodiments, the bolt is capable of being installed in the receiver with the first side up and the bolt is capable of being installed in the receiver with the second side up. Further, in some embodiments, for example, the receiver is capable of receiving the bolt with the first side up and the receiver is capable of receiving the bolt in the receiver with the second side up.

Further, as used herein, a bolt being contained within a receiver means that the bolt (e.g., 70) is located within the receiver (e.g., 11) when the firearm (e.g., 10) is assembled and ready to fire. In a number of embodiments, such bolt can be shipped or sold external to the receiver. In a number of embodiments, the receiver (e.g., 11) consists of or includes an upper receiver and a lower receiver that can be separated, for example, to access the bolt, bolt carrier group, other internal components, or a combination thereof. In some embodiments, for instance, the upper receiver and the lower receiver are hingedly attached to each other, for instance, at a forward end.

In some embodiments, this receiver (e.g., 11) is specifically the upper receiver of the firearm (e.g., 10). Further, in a number of embodiments, the firearm includes a carrier (e.g., 75) having a forward end (e.g., 76) and a rearward or aft end (e.g., 77) opposite the forward end. In various embodiments, the bolt (e.g., 70) engages the carrier (e.g., 75) at the forward end (e.g., 76) of the carrier. In various embodiments, the bolt (e.g., 70) and the forward end (e.g., 76) of the carrier (e.g., 75) are configured so that the bolt can operationally engage the forward end of the carrier with the first side (e.g., 71) up and the bolt can operationally engage the forward end of the carrier with the second side (e.g., 82) up (i.e., without rotating the carrier). As used herein, "operationally engage" means engage in a manner so that the firearm (e.g., 10) can fire multiple rounds and operate properly.

Broadly speaking, in a number of embodiments, a firearm (e.g., 10) includes a left side (e.g., 31), a right side (e.g., 32), a left cover (e.g., 21) at the left side, a right cover (e.g., 22) at the right side, a passageway (e.g., 66) extending from the left side (e.g., 31) to the right side (e.g., 32), and an opening mechanism (e.g., bolt protrusions 91 and 92 on bolt 70 shown in FIGS. 9-11) that opens both the left cover (e.g., 21) and the right cover (e.g., 22). Such a cover can be an ejection port cover, for example, in some embodiments, as shown. Other embodiments may have a different type of cover. In a number of embodiments, such a passageway (e.g., 66) can provide for cross ventilation, for example, between the two covers.

Moreover, such an opening mechanism (e.g., bolt protrusions 91 and 92 on bolt 70) can be an apparatus (e.g., bolt protrusions 91 and 92 on bolt 70) that opens the covers. In a number of embodiments, an opening mechanism (e.g., bolt protrusions 91 and 92 on bolt 70), or parts that form or contribute to the opening mechanism, can have other functions as well. In some embodiments, for instance, an opening mechanism can include a bolt (e.g., 70) for the firearm (e.g., 10 or part or multiple parts of the bolt, for instance, bolt protrusions 91 and 92 on bolt 70). Further, in some embodiments, an opening mechanism (e.g., bolt protrusions 91 and 92 on bolt 70) can include a carrier (e.g., 75) for the firearm or part or multiple parts of the carrier, as other examples.

Further, in various embodiments, a firearm (e.g., 10) includes a left port (e.g., 41) at the left side (e.g., 31), a right port (e.g., 42) at the right side (e.g., 32), a left cover (e.g., 21) at the left port, a right cover (e.g., 22) at the right port, a passageway (e.g., 66, for instance, through the firearm) extending from the left port (e.g., 41) to the right port (e.g., 42), and an opening mechanism (e.g., bolt protrusions 91 and 92 on bolt 70) that automatically opens both the left cover and the right cover when the firearm is discharged. In a number of embodiments, when the left cover (e.g., 21) is closed, the left cover covers the left port (e.g., 41) covering the passageway (e.g., 66) at the left side (e.g., 31), and when the right cover (e.g., 22) is closed, the right cover covers the right port (e.g., 42) covering the passageway (e.g., 66) at the right side (e.g., 32). Moreover, in a number of embodiments, such a covering (e.g., 21 or 22) is not necessarily air or water tight, but can serve to reduce or eliminate the amount of dust, dirt, rain, snow, mud, debris, or other material that enters the port or ports (e.g., when the firearm is not being fired). Even further, in various embodiments, when the left cover (e.g., 21) opens, the left cover uncovers the left port (e.g., 41) opening the passageway (e.g., 66) at the left side (e.g., 31), and when the right cover (e.g., 22) is opened, the right cover uncovers the right port (e.g., 42) opening the passageway (e.g., 66) at the right side (e.g., 32), for example.

In a number of embodiments, the opening mechanism (e.g., bolt protrusions 91 and 92 on bolt 70) automatically opens both the left cover (e.g., 21) and the right cover (e.g., 22) when the firearm (e.g., 10) is discharged. Further, in some embodiments, the opening mechanism (e.g., bolt protrusions 91 and 92 on bolt 70) automatically opens both the left cover and the right cover when a round is chambered within the firearm. Still further, in some embodiments, the opening mechanism automatically opens both the left cover and the right cover when the bolt moves (e.g., either forward or rearward) within the firearm. Even further, in some embodiments, the firearm includes a carrier (e.g., 75) and the opening mechanism automatically opens both the left cover and the right cover when the carrier moves (e.g., forward or rearward) within the firearm, as another example.

As used herein, "automatically", in the context of opening a cover, means without the human operator of the firearm manually taking some specific action to open the cover (i.e., other than firing the firearm or pulling back the bolt, for instance, with the charging handle), such as manually pulling the cover open, manually actuating a latch that holds the cover closed, or manually operating any control that initiates the action of opening one or more covers without also performing some higher function. Further, as used herein, unless stated otherwise, the opening of a cover is considered to be "automatically" performed if the opening of the cover is triggered by the firing of the firearm, moving of the bolt or carrier (e.g., by firing the firearm or moving with the charging handle to cock the firearm), firing or moving of one or more rounds within the firearm, or the releasing of a safety for the firearm.

In particular embodiments, the left port and the right port are ejection ports and the left cover and the right cover are ejection port covers. Further, in certain embodiments, the left and right covers are dust covers. Other embodiments, however, may differ. In particular embodiments, a firearm (e.g., 10) includes a left ejection port (e.g., 41), a right ejection port (e.g., 42), a left dust cover (e.g., 21) at the left ejection port, a right dust cover (e.g., 22) at the right ejection port, a passageway (e.g., 66) extending from the left ejection port to the right ejection port, and an opening mechanism (e.g., bolt protrusions 91 and 92 on bolt 70) that automatically opens both the left dust cover and the right dust cover when the firearm is discharged, when a round is chambered within the firearm, when the bolt moves within the firearm, when the carrier moves within the firearm, or a combination thereof. As used herein, a dust cover (e.g., 21 or 22) is capable of keeping out at least some dust from the passageway (e.g., 66) when the dust cover is closed in comparison with when the dust cover is open. As used herein, however, a dust cover does not necessarily keep out every particle of dust. Further, as used herein, an ejection port (e.g., 41 or 42) is a port where shell casings are ejected from the firearm once fired, at least if the firearm is configured to use that port to eject shell casings. In a number of embodiments, only one ejection port is used at a time for ejecting shell casings, but both ports that can be used for ejecting shell casings (e.g., depending on how the firearm is assembled) are considered to be ejection ports (e.g., left and right ejection ports).

In various embodiments, the firearm (e.g., 10) includes a left hinge (e.g., 51 shown in FIGS. 4 and 5), a right hinge (e.g., 52 shown in FIGS. 4 and 5), or both. In certain embodiments, for example, the left cover (e.g., 21) or dust cover is attached to the receiver (e.g., 11) with the left hinge (e.g., 51), and the right cover (e.g., 22) or dust cover is attached to the receiver with the right hinge (e.g., 52). In a number of embodiments, the covers pivot at the hinge, for example, to open or close. In some embodiments, the hinge is at the top of the cover, the top of the port, or both, for example. In other embodiments, however, the hinge (e.g., 51 and 52) is at the bottom of the cover (e.g., 21 and 22), the bottom of the port (e.g., 41 or 42), or both, for example (e.g., as shown). In some embodiments, the cover pivots or swings (e.g., at the hinge) out and up to open, or out and down (e.g., as shown) to open, for example, 90 degrees, more than 90 degrees, or between 90 and 180 degrees, as examples.

Further, in some embodiments, the firearm (e.g., 10) includes a left spring (e.g., 56 shown in FIGS. 2, 4, and 5) and a right spring (e.g., 57 shown in FIGS. 1, 2, and 4-6). Even further, in particular embodiments, the left cover or dust cover (e.g., 21) is biased (e.g., pushed or pulled) open with the left spring (e.g., 56), and the right cover or dust cover (e.g., 22) is biased open with the right spring (e.g., 57) for instance, about or at the left and right hinges (e.g., 51 and 52), respectively. Further still, in a number of embodiments, including the embodiment shown, the left spring (e.g., 56) is a helical spring and the right spring (e.g., 57) is a helical spring, and in certain embodiments, the left spring (e.g., 56) is a torsion spring and the right spring (e.g., 57) is a torsion spring, as examples. In some embodiments (e.g., as shown), helical springs are also torsion springs, but other embodiments may differ in one or both of these respects. In a number of embodiments, the springs bias or hold the covers open unless the covers are manually pushed or held closed.

Moreover, in some embodiments, the firearm (e.g., 10) includes a left latch (e.g., 46 shown in FIGS. 4 and 5) and a right latch (e.g., 47 shown in FIGS. 4-6), the left cover or dust cover (e.g., 21) is held closed with the left latch (e.g., 46), and the right cover or dust cover (e.g., 22) is held closed with the right latch (e.g., 57). In a number of embodiments, the covers (e.g., 21 and 22) are held closed by these latches (e.g., 46 and 47) against the opening forces applied by the springs (e.g., 56 and 57). In some embodiments, a latch (e.g., 46 or 47) may include an interference fit, a detent, a magnet, another spring, or a combination thereof, as examples. In certain embodiments, a detent engages a small undercut on the inside of the port opening on the upper receiver, for example. This allows the cover to remain securely closed until the bolt and/or carrier move back or forward, for instance, to automatically open the cover. In this example, the latch includes the detent and the undercut. In some embodiments, the latch further includes a spring (e.g., that pushes the detent).

In a number of embodiments, the left cover or dust cover (e.g., 21) is held closed with the left latch (e.g., 46) when the left cover or dust cover is manually pushed closed (e.g., against the force of the left spring, for instance, 56), and the right cover or dust cover (e.g., 22) is held closed with the right latch (e.g., 47) when the right cover or dust cover is manually pushed closed. The person or operator using the firearm (e.g., 10) may manually close one or both dust covers (e.g., 21, 22, or both) by pushing it or them closed (e.g., with a hand or fingers, bare or gloved), for example, when the person or operator is finished firing the firearm (e.g., 10), when the firearm is sufficiently cool, or when the person or operator perceives a need to keep foreign materials out of the firearm (e.g., out of ports 41, 42, or both), as examples. In some embodiments, the opening mechanism opens (e.g., automatically) the left cover or dust cover and the right cover or dust cover by releasing the left latch and the right latch. Further, in certain embodiments, the opening mechanism opens (e.g., automatically) the left cover or dust cover and the right cover or dust cover by pushing the left cover and the right cover open, overcoming the left latch and the right latch.

Further, in various embodiments, the opening mechanism includes a left bolt feature and a right bolt feature (i.e., located on the bolt of the firearm). In particular embodiments, the left bolt feature includes a left bolt protrusion and the right bolt feature includes a right bolt protrusion, as examples. Bolt protrusions 91 and 92 on bolt 70 are examples of left and right bolt features and left and right bolt protrusions, as examples. Further still, in some embodiments, the firearm includes a carrier, and the opening mechanism includes a left carrier feature and a right carrier feature. In particular embodiments, the left carrier feature includes a left carrier protrusion and the right carrier feature includes a right carrier protrusion, as other examples. In other embodiments, such a bolt or carrier feature can be a hole, a pin, a tab, or an indentation, as other examples.

Moreover, in various embodiments, the bolt (e.g., 70) includes an ejection pin (e.g., 85), the bolt includes a extractor claw (e.g., 86), or both. Still further, in some embodiments, the opening mechanism includes a left cover feature (e.g., 26 shown in FIGS. 2, 4, and 5) and a right cover feature (e.g., 27 shown in FIGS. 1, 2, and 4-6). In certain embodiments, the left cover feature (e.g., 26) is part of the left cover or dust cover (e.g., 21) and the right cover feature (e.g., 27) is part of the right cover or dust cover (e.g., 22), as examples (e.g., as shown). Even further, in particular embodiments, the left cover feature (e.g., 26) is or includes a left cover protrusion and the right cover feature (e.g., 27) is or includes a right cover protrusion. In other embodiments, such a cover feature can be a hole, a pin, a tab, or an indentation, as other examples.

Even further still, in some embodiments, the left cover or dust cover (e.g., 21) opens when the left bolt feature (e.g., 91) or carrier feature (e.g., in other embodiments) contacts or strikes the left cover feature (e.g., 26) and the right cover or dust cover (e.g., 22) opens when the right bolt feature (e.g., 92) or carrier feature (e.g., in other embodiments) contacts or strikes the right cover feature (e.g., 27), as examples. Such contact can initiate opening of the covers (e.g., 21 and 22), for example, by pushing the covers outward to overcome the latches (e.g., 26 and 27) and allow the springs (e.g., 56 and 57) to open the covers for the ejection of shell casings, cross ventilation and cooling of the firearm (e.g., 10), or both. In other embodiments, the bolt, carrier, or opening mechanism contacts the latch to open the covers, as other examples.

Certain embodiments include various firearms (e.g., 10) that include a left ejection port (e.g., 41), a right ejection port (e.g., 42), a left dust cover (e.g., 21) at the left ejection port, a right dust cover (e.g., 22) at the right ejection port, a passageway (e.g., 66) extending from the left ejection port to the right ejection port, and a bolt carrier group (e.g., bolt 70 and carrier 75) having a first feature (e.g., bolt protrusion 91) and a second feature (e.g., bolt protrusion 92). In various embodiments, for example, the first feature (e.g., bolt protrusion 91) automatically opens the left dust cover (e.g., 21) at the left ejection port 41) when the bolt carrier group (e.g., bolt 70 and carrier 75) moves and the second feature (e.g., bolt protrusion 92) automatically opens the right dust cover (e.g., 22) at the right ejection port (e.g., 42) when the bolt carrier group moves, for example, to provide cross ventilation through the passageway (e.g., 66) to the bolt carrier group when the left dust cover and the right dust cover are open. In a number of embodiments, opening of the dust covers (e.g., 21 and 22) also allows shell casings to be ejected through (e.g., one of) the ejection ports (e.g., 41 and 42), for instance, depending on the orientation in which the bolt (e.g., 70) is installed.

Further, in various embodiments, for example, the bolt carrier group includes a carrier (e.g., 75) and a bolt (e.g., 70) having a first side (e.g., 71) and a second side (e.g., 82). In a number of embodiments, for example, the bolt (e.g., 70) can be installed in the carrier (e.g., 75) with the first side up (e.g., 71 as shown in FIG. 7), and the bolt (e.g., 70) can be installed in the carrier (e.g., 75) with the second side up (e.g., 82 as shown in FIG. 8), i.e., relative to the orientation of the carrier (e.g., 75). Moreover, in a number of embodiments, when the bolt (e.g., 70) is installed in the carrier (e.g., 75) with the first side (e.g., 71) up, shell casings are ejected though the right ejection port (e.g., 42), and when the bolt (e.g., 70) is installed in the carrier (e.g., 75) with the second side (e.g., 82) up, shell casings are ejected though the left ejection port (e.g., 41).

In a number of embodiments, the firearm is a rifle. In particular embodiments, for example, the firearm is an assault rifle, such as an AR-15 or an M-16. In some embodiments, the firearm can be a semi-automatic firearm or a fully automatic firearm, as examples. Further, in particular embodiments, the firearm is a rifle configured to selectably (e.g., via operation of a selector lever) fire in a fully-automatic mode and in a semi-automatic mode. Other embodiments, however, may differ. For instance, in particular embodiments the firearm can be a pistol.

Examples of methods include various methods of configuring a firearm (e.g., 10) to selectably eject shell casings through either side (e.g., 31 or 32) of the firearm. In this context, "selectably" means that an owner or operator of the firearm can select which side of the firearm the shell casings are ejected from (e.g., by changing the orientation of the bolt). Some methods include at least one act of configuring the firearm so that a bolt (e.g., 70) of the firearm can be installed in the firearm in either of two different orientations, for example. In a number of embodiments, when the bolt is installed in a first orientation (e.g., shown in FIG. 7), shell casings are ejected though a right ejection port (e.g., 42), and when the bolt is installed in a second orientation (e.g., shown in FIG. 8), shell casings are ejected though a left ejection port (e.g., 41), for instance. Other methods include methods of obtaining or providing a firearm that will selectably eject shell casings through either side of the firearm. In a number of embodiments, such a method includes an act of obtaining or providing the firearm (e.g., 10) wherein a bolt (e.g., 70) of the firearm can be installed in the firearm in either of two different orientations. In various embodiments, when the bolt is installed in a first orientation, shell casings are ejected though a right ejection port, and when the bolt is installed in a second orientation, shell casings are ejected though a left ejection port.

Further examples of methods include various methods of cooling a firearm (e.g., 10). Some methods include at least an act of opening two covers (e.g., 21 and 22) on opposite sides (e.g., 31 and 32) of the firearm (e.g., 10) when the firearm is discharged to provide cross ventilation through the firearm when the two covers are open. Further, in some embodiments, a method includes opening two ejection port covers (e.g., 21 and 22), specifically, on opposite sides of the firearm when the firearm is discharged to provide cross ventilation through the firearm ejection ports (e.g., specifically) when the two ejection port covers are open. For example, some embodiments include a first act of opening a left cover (e.g., ejection port cover 21) and a second act of opening a right cover (e.g., 22). In different embodiments, the first act and the second act can be performed in either order or at the same time, as examples.

Still other methods include methods of obtaining or providing a bolt (e.g., 70) for a firearm (e.g., 10) that will selectably eject shell casings through either side of the firearm (e.g., using the same bolt and without introducing or changing out any other parts of the firearm). Such methods can include, for example, obtaining or providing the bolt of the firearm that can be installed in the firearm in either of two different orientations such that when the bolt is installed in a first orientation, shell casings are ejected though a right ejection port, and when the bolt is installed in a second orientation, shell casings are ejected though a left ejection port. In various embodiments, particular methods can include acts of obtaining or providing, as examples, other features, components, or aspects described herein. All possible combinations are contemplated. Further, methods described herein contain various acts. The order in which these acts are described is an example of the order in which these acts can be performed, but in other embodiments, unless stated otherwise herein, the acts may be performed in a different order. In some embodiments, acts may overlap or be performed at the same time, as another example.

Still other specific embodiments include various bolts (e.g., 70) for a firearm (e.g., 10), the firearm having a left ejection port (e.g., 41) and a right ejection port (e.g., 42). In a number of embodiments, the bolt has a first side (e.g., 71) and a second side (e.g., 82) and is configured so that the bolt can be installed in the firearm (i.e., operationally) with the first side up (e.g., as shown in FIG. 7) and the bolt can be installed in the firearm with the second side up (e.g., as shown in FIG. 8). In a number of embodiments, for example, when the bolt is installed in the firearm with the first side up, shell casings are ejected though the right ejection port (e.g., 42), and when the bolt is installed in the firearm with the second side up, shell casings are ejected though the left ejection port (e.g., 41). Further, in some embodiments, a bolt for a firearm includes a first set of ejection features on a first side of the bolt and a second set of ejection features on a second side of the bolt, and the second set of ejection features is a mirror opposite of the first set of ejection features. Still further, various embodiments of bolts include other features described herein. All possible combinations are contemplated.

Even further, various embodiments include providing a mechanism that automatically opens two ejection port covers (e.g., 21 and 22) on opposite sides (e.g., 31 and 32) of a firearm (e.g., 10), for example, when a bolt (e.g., 70) or carrier of the firearm moves, for instance, to provide cross ventilation through the firearm ejection ports (e.g., 41 and 42) when the two ejection port covers are open. Further still, some embodiments include obtaining or providing at least two protrusions (e.g., 91 and 92) on the bolt (e.g., 70) of the firearm (e.g., 10), for example, that automatically open two ejection port covers (e.g., 21 and 22) on opposite sides of the firearm when the bolt or carrier of the firearm moves, for instance, to provide cross ventilation through the firearm ejection ports (e.g., 41 and 42) when the two ejection port covers are open.

Further, various embodiments of the subject matter described herein include various combinations of the acts, structure, components, and features described herein, shown in the drawings, described in documents that are incorporated by reference herein, or that are known in the art. Moreover, certain procedures can include acts such as manufacturing, obtaining, or providing components that perform functions described herein or in the documents that are incorporated by reference. The subject matter described herein also includes various means for accomplishing the various functions or acts described herein, in the documents that are incorporated by reference, or that are apparent from the structure and acts described. Essentially, wherever a function is described herein, and at least one example of structure is described, illustrated, or both, that performs that function, a means for accomplishing that function is also contemplated.

Further, as used herein, the word "or", except where indicated otherwise, does not imply that the alternatives listed are mutually exclusive. Even further, where alternatives are listed herein, it should be understood that in some embodiments, fewer alternatives may be available, or in particular embodiments, just one alternative may be available, as examples.

What is claimed is:

1. A firearm comprising a left side, a right side, a left port at the left side, a right port at the right side, a left cover at the left port, a right cover at the right port, a passageway extending from the left port to the right port, and an opening mechanism that automatically opens both the left cover and the right cover when the firearm is discharged, wherein: when the left cover is closed, the left cover covers the left port covering the passageway at the left side; when the right cover is closed, the right cover covers the right port covering the passageway at the right side; when the left cover opens, the left cover uncovers the left port opening the passageway at the left side; and when the right cover is opened, the right cover uncovers the right port opening the passageway at the right side.

2. The firearm of claim 1 wherein the opening mechanism automatically opens both the left cover and the right cover when a round is chambered within the firearm.

3. The firearm of claim 1 wherein the left port is a left ejection port, the right port is a right ejection port, the left cover is a left dust cover at the left ejection port, and the right cover is a right dust cover at the right ejection port.

4. The firearm of claim 3 wherein: the firearm comprises a receiver, a left hinge, a right hinge, a left spring, a right spring, a left latch, and a right latch; the left dust cover is attached to the receiver with the left hinge; the right dust cover is attached to the receiver with the right hinge; the left dust cover is biased open with the left spring; the right dust cover is biased open with the right spring; the left dust cover is held closed with the left latch; and the right dust cover is held closed with the right latch.

5. The firearm of claim 4 wherein the left dust cover is held closed with the left latch when the left dust cover is manually pushed closed; the right dust cover is held closed with the right latch when the right dust cover is manually pushed closed; and the opening mechanism opens the left dust cover and the right dust cover by releasing the left latch and the right latch.

6. The firearm of claim 5 wherein: the firearm comprises a bolt; the opening mechanism comprises a left bolt feature and a right bolt feature; the opening mechanism comprises a left cover feature and a right cover feature; the left cover feature is part of the left dust cover; the right cover feature is part of the right dust cover; the left dust cover opens when the left bolt feature contacts the left cover feature; and the right dust cover opens when the right bolt feature contacts the right cover feature.

7. The firearm of claim 1 comprising a bolt having a first side and a second side, wherein: the bolt can be installed in the firearm with the first side up; the bolt can be installed in the firearm with the second side up; when the bolt is installed in the firearm with the first side up, shell casings are ejected though the right port; and when the bolt is installed in the firearm with the second side up, the shell casings are ejected though the left port.

8. The firearm of claim 7 wherein: the firearm comprises a receiver comprising the left port and the right port; the bolt is contained within the receiver; and the bolt and the receiver are configured so that the bolt can be installed in the receiver with the first side up and the bolt can be installed in the receiver with the second side up.

9. The firearm of claim 7 wherein: the bolt has a central axis; and when the bolt is installed in the firearm with the second side up, the bolt is rotated 180 degrees around the central axis from when the bolt is installed in the firearm with the first side up.

10. The firearm of claim 9 wherein: the bolt comprises an ejection pin; when the bolt is installed in the firearm with the first side up so that the shell casings are ejected though the right ejection port, the ejection pin is left of the central axis of the bolt, between the central axis and the left side of the firearm; and when the bolt is installed in the firearm with the second side up so that the shell casings are ejected though the left ejection port, the ejection pin is right of the central axis of the bolt, between the central axis and the right side of the firearm.

11. The firearm of claim 9 wherein: the bolt comprises an extractor claw; when the bolt is installed in the firearm with the first side up so that the shell casings are ejected though the right ejection port, the extractor claw is right of the central axis of the bolt, between the central axis and the right side of the firearm; and when the bolt is installed in the firearm with the second side up so that the shell casings are ejected though the left ejection port, the extractor claw is left of the central axis of the bolt, between the central axis and the left side of the firearm.

12. The firearm of claim 1 further comprising a bolt wherein: the bolt comprises a first set of ejection features on a first side of the bolt and a second set of ejection features on a second side of the bolt; and the second set of ejection features is a mirror opposite of the first set of ejection features.

13. The firearm of claim 1 wherein: the firearm comprises a bolt having a first side and a second side and a carrier comprising a forward end; the bolt engages the carrier at the forward end of the carrier; and the bolt and the forward end of the carrier are configured so that the bolt can operationally engage the forward end of the carrier with the first side up and the bolt can operationally engage the forward end of the carrier with the second side up.

14. A firearm comprising a left ejection port, a right ejection port, a left dust cover at the left ejection port, a right dust cover at the right ejection port, a passageway extending from the left ejection port to the right ejection port, and a bolt carrier group having a first feature and a second feature; wherein the first feature automatically opens the left dust cover when the bolt carrier group moves and the second feature automatically opens the right dust cover when the bolt carrier group moves to provide cross ventilation through the passageway to the bolt carrier group when the left dust cover and the right dust cover are open.

15. The firearm of claim 14 wherein: the bolt carrier group comprises a carrier and a bolt, the bolt having a first side and a second side; the bolt can be installed in the carrier with the first side up; the bolt can be installed in the carrier with the second side up; and when the bolt is installed in the carrier with the first side up, shell casings are ejected though the right ejection port; and when the bolt is installed in the carrier with the second side up, the shell casings are ejected though the left ejection port.

16. The firearm of claim 15 wherein: the bolt comprises a first set of ejection features on the first side of the bolt and a second set of ejection features on the second side of the bolt; and the second set of ejection features is a mirror opposite of the first set of ejection features.

17. The firearm of claim 15 wherein: the firearm comprises a receiver comprising the left ejection port and the right ejection port; the bolt is contained within the receiver; and the bolt and the receiver are configured so that the bolt can be installed in the receiver with the first side up and the bolt can be installed in the receiver with the second side up.

18. The firearm of claim 15 wherein: the carrier comprises a forward end; the bolt engages the carrier at the forward end of the carrier; and the bolt and the forward end of the carrier are configured so that the bolt can operationally engage the forward end of the carrier with the first side up and the bolt can operationally engage the forward end of the carrier with the second side up.

19. The firearm of claim 15 wherein: the bolt has a central axis; and when the bolt is installed in the firearm with the second side up, the bolt is rotated 180 degrees around the central axis from when the bolt is installed in the firearm with the first side up.

20. The firearm of claim 19 wherein: the bolt comprises an ejection pin; when the bolt is installed in the firearm with the first side up so that the shell casings are ejected though the right ejection port, the ejection pin is left of the central axis of the bolt, between the central axis and a left side of the firearm; and when the bolt is installed in the firearm with the second side up so that the shell casings are ejected though the left ejection port, the ejection pin is right of the central axis of the bolt, between the central axis and a right side of the firearm.

21. The firearm of claim 19 wherein: the bolt comprises an extractor claw; when the bolt is installed in the firearm with the first side up so that the shell casings are ejected though the right ejection port, the extractor claw is right of the central axis of the bolt, between the central axis and a right side of the firearm; and when the bolt is installed in the firearm with the second side up so that the shell casings are ejected though the left ejection port, the extractor claw is left of the central axis of the bolt, between the central axis and a left side of the firearm.

* * * * *